US006918806B2

(12) United States Patent
Skedeleski

(10) Patent No.: US 6,918,806 B2
(45) Date of Patent: Jul. 19, 2005

(54) SAFETY FIN OVER MOLD SYSTEM AND SAFETY FIN SLEEVE FOR SURFBOARD AND OTHER RECREATIONAL VEHICLES

(75) Inventor: David Skedeleski, Pearl City, HI (US)

(73) Assignee: Surfco Hawaii, Pearl City, HI (US)

( * ) Notice: Subject to any disclaimer, the term of this patent is extended or adjusted under 35 U.S.C. 154(b) by 0 days.

(21) Appl. No.: 10/695,865

(22) Filed: Oct. 30, 2003

(65) Prior Publication Data

US 2004/0121671 A1 Jun. 24, 2004

Related U.S. Application Data

(60) Provisional application No. 60/434,443, filed on Dec. 19, 2002.

(51) Int. Cl.[7] ..... B63B 1/00
(52) U.S. Cl. ..... 441/79; 114/140
(58) Field of Search ..... 441/74, 79; 114/140, 114/357

(56) References Cited

U.S. PATENT DOCUMENTS

| | | | |
|---|---|---|---|
| 1,592,671 | A | 7/1926 | Nichols |
| 2,800,731 | A | 7/1957 | Carson |
| 3,259,680 | A | 7/1966 | Schelke |
| 3,364,292 | A | 1/1968 | Lemelson |
| 4,325,154 | A | 4/1982 | Collum, Jr. |
| 4,798,549 | A | 1/1989 | Hirsch |
| 5,032,096 | A | 7/1991 | Scott et al. |
| 5,186,883 | A | 2/1993 | Beall, III |
| 5,242,322 | A | 9/1993 | Chellemi et al. |
| 5,273,472 | A | 12/1993 | Skedeleski et al. |
| 5,480,331 | A | 1/1996 | Lewis |
| 5,690,884 | A | 11/1997 | Cerny |
| 5,798,071 | A | 8/1998 | Boehm |
| 5,951,347 | A | 9/1999 | Hudson et al. |
| 6,135,836 | A | 10/2000 | Rhynsburger |
| 6,257,941 | B1 | 7/2001 | Rhynsburger |
| 6,394,865 | B1 | 5/2002 | Arzadon |
| 6,475,423 | B1 | 11/2002 | Masterson et al. |

FOREIGN PATENT DOCUMENTS

| | | |
|---|---|---|
| JP | 3-176292 | 7/1991 |

*Primary Examiner*—Ed Swinehart
(74) *Attorney, Agent, or Firm*—Nixon & Vanderhye, P.C.

(57) ABSTRACT

A fin for an recreational device including: a rigid fin core having opposite sides, at least one edge and a base; at least one registration post on each of the opposite sides of the core, and a flexible material at least partially covering the core, wherein the flexible material include leading and trailing fin edges extending outward from the edge of the core and the flexible material is flush with an end surface of each of the at least one registration post.

20 Claims, 5 Drawing Sheets

SAFETY FIN OVER MOLD SYSTEM AND SAFETY FIN SLEEVE FOR SURFBOARD AND OTHER RECREATIONAL VEHICLES

RELATED APPLICATION

Priority is claimed to U.S. Provisional Patent Application Ser. No. 60/434,443, filed Dec. 19, 2002, the entirety of which is incorporated by reference.

BACKGROUND

Surfboard safety fins with a rigid core and soft outer edges are disclosed in U.S. Pat. Nos. 5,273,472 and 5,941,347. The soft outer edges of these prior safety fins are generally a flexible edge border attached to the edge of a rigid fin core. The trailing and leading edges of the core have a raised ridge to provide a mount for the border. The edge border is molded to the core and over the ridge. The sides of the fin are the hard plastic exposed sides of the core.

A technique has been developed to encase the entire rigid core of a surfboard fin in a flexible material using plastic injection molding and to center the core in the mold cavity. Encasing the entire rigid fin core with a soft flexible material produces a safety fin. The entire core, including sides, is substantially covered by the soft flexible material. The flexible material can be extended to form borders around the leading and trailing edge of the fin core. The over molding technique creates a fin having a soft leading trail edge of a surfboard fin formed of a flexible material.

Fins with an over molded rigid core have been produced in the past using a method called "castable molding." A rigid core is set into a mold filled with a soft flexible urethane material. The shape of the over mold determines the shape of the fin. The urethane cures after the fin core is inserted into the mold.

One of the problems with the castable molding method is keeping the core properly aligned in the urethane over mold. The standard alignment method is to clamp the base of the fin core in a device above the mold. If the fin core is not aligned properly or is not held in its correct position during the curing process of the over mold material, the fin core will be offset in the over mold. The resulting fin will not be useable for surfing. Another problem with castable molding is the slow curing time of the urethane. This problem extends the production time and increasing the costs of the fins. In view of these problems, over molded fins are no longer generally sold in the market place and were a commercial failure.

A faster and more cost effective method of over molding a core involves injection molding a soft material over a core. The core is clamped at its base, and is suspended or cantilevered inside the over mold cavity. The plastic material is injected into the cavity to over mold the entire core and fill the cavity.

The core alignment problem still exists with injection molding method. The pressure of the injected material into the fin cavity can bend or shift the suspended fin core in the mold cavity. Keeping a rigid fin core properly aligned in a mold cavity during the injection process is difficult. Failing to maintain proper alignment of the core in the mold may result in a high molded fin rejection rate. Accordingly, a method and apparatus is needed to align a fin core in an over mold so as to form a soft layer of safety fin.

SUMMARY OF INVENTION

Methods and apparatus have been developed for castable and injection molding of a soft material over a rigid or flexible fin core.

In a first embodiment, the invention is a fin for an recreational device comprising: a rigid fin core having opposite sides, at least one edge and a base; at least one registration post on each of said opposite sides of the core, and a flexible material at least partially covering said core, wherein said flexible material further comprises leading and trailing fin edges extending outward from said at least one edge of the core, wherein flexible material over is flush with an end surface of the registration posts. The registration post may have logos, text and graphics embedded on an outer end surface of the post. The fin may be for a surfboard, snowboard, water ski, jet ski or other such recreational devices.

In a second embodiment, the invention is an over mold system for a fin for a recreational device comprising: an over mold cavity having an inner surface shaped to match an outer surface of said fin, wherein the mold cavity has a first width; a rigid fin core having opposite sides, at least one edge and a base, wherein said core has a second width substantially narrower than said first width of the cavity; at least one registration post on each of said opposite sides of the core, and a flexible material injected into said cavity and at least partially covering said core, wherein said flexible material further comprises leading and trailing fin edges extending outward from said at least one edge of the core, wherein the flexible material over said sides is flush with an end surface of each of the at least one post.

In a third embodiment, the invention is a sleeve for a rigid fin of a recreational device comprising: a sleeve envelope have a cavity to receive the rigid fin, wherein said cavity conforms to an outer shape of said fin; a soft, flexible border to said envelope forming a leading and trailing edge of said envelope, wherein said boarder is substantially parallel to said rigid fin and said border defines a perimeter of the cavity, and an open edge of the cavity adapted to slide over the rigid fin and to abut to a base area of said fin.

DETAILED DESCRIPTION OF THE INVENTION

Figure 1:
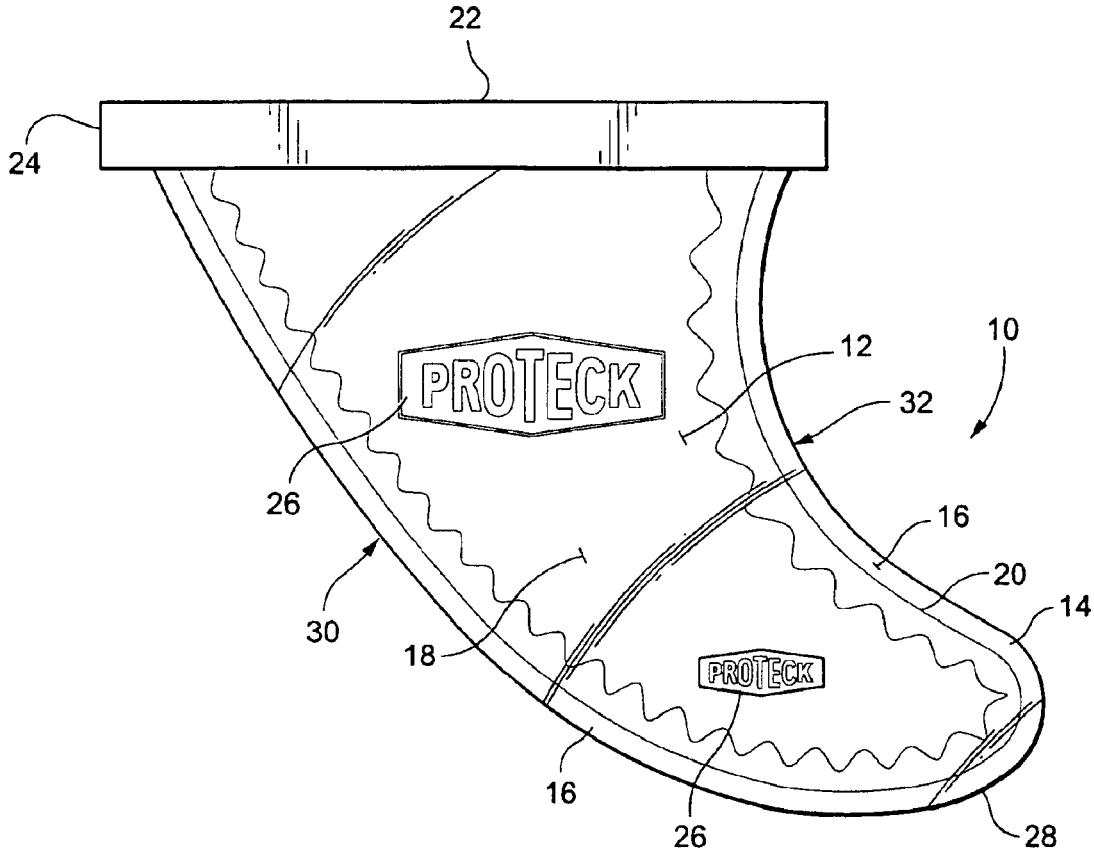
FIG. 1 is a side view of a surfboard fin with a soft outer covering.

FIG. 1 is a side view of an exemplary surfboard fin, but could be configured as a fin 10 of a water ski, wind surfboard, water ski, wake board, jet ski or other recreational device. The fin may have a rounded tip 28 at an intersection between the leading 30 and trailing 32 edges. The leading and trailing edges are curved, with leading edge 30 curved toward the trailing edge 32. The fin includes a rigid core 12 and a soft outer layer 14 formed by plastic injection molding. The soft outer layer includes a flexible border 16 along the exposed edge of the fin. The flexible border of the outer layer forms the leading and trailing edges 30,32 of the fin.

The flexible edge borders 16 are generally associated with safety fins. The flexible borders tend to reduce injuries when and if the board passes close to a person and the fins hits the person. The soft borders of the fin reduce the cuts and bruises that often result from the impact of a fin against a person.

The soft outer layer 14 covers the outer surfaces of the rigid core, including the sides 18 and edges 20 of the core. The thickness of the outer layer 14 may be uniform or may vary. For example, the layer may be relatively thick at the soft leading and trailing borders. The layer may become thinner along the core side and towards the center of the side of the fin.

The fin core has a base 22 at top edge of the core. The base may include a platform 24 aligned with a plane of the fin. The base fits into a slot on an underside surface of a surfboard and attached to the surfboard. The base 22 may be detachably connected to the surfboard to allow the fin to be removed for replacement or repair.

Figure 2:
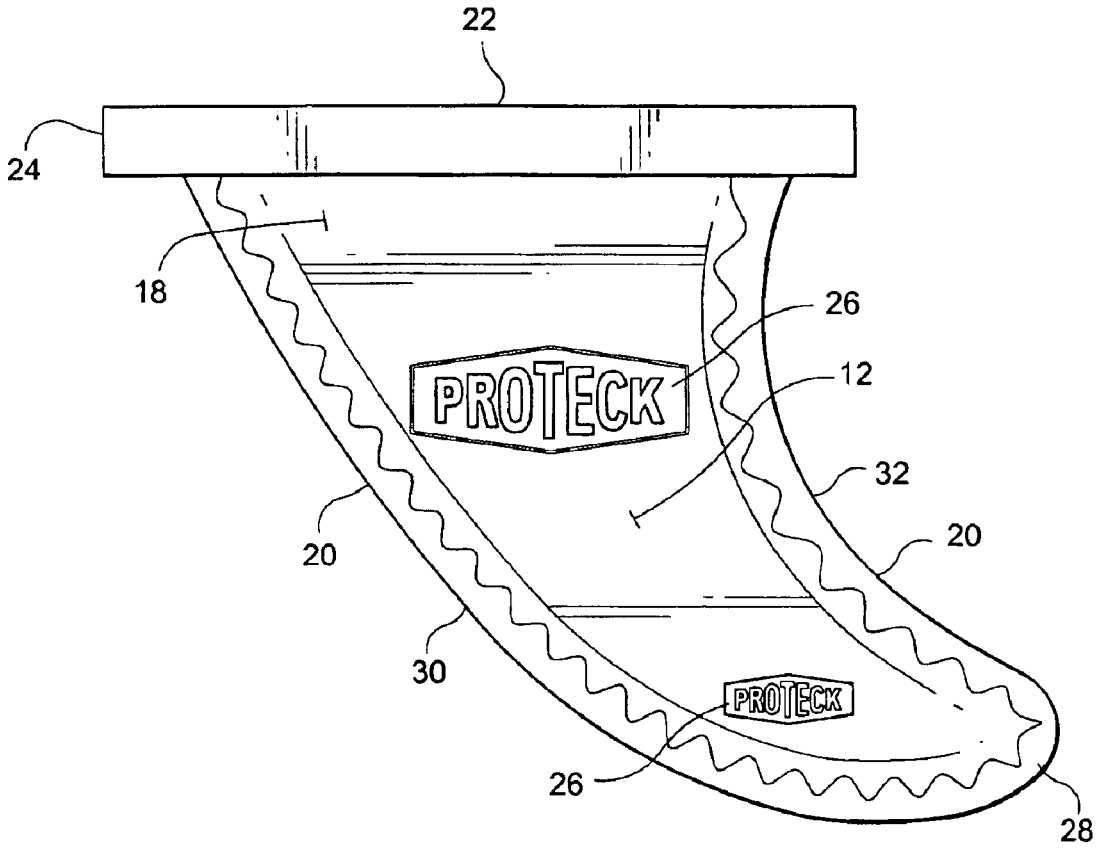
FIG. 2 is a side view of a rigid fin core without the soft outer covering shown in FIG. 1.

FIG. 2 is a side view of the fin rigid core 12 without a covering layer. The rigid core 12 may be a rigid plastic member having a shape similar to a surfboard fin reduced in size. The core may be relatively thin with respect to the fin height (the distance from the base 22 to the tip 28 of the fin) and with respect to the fin width (the distance from the leading to trailing edges 30,32 of the fin). The ratio of the thickness to the height and to the width of the fin may be at least 1 to 10. The core may be formed of a hard plastic material such as polyester polycaprolactone.

The opposite sides 18 of the rigid core 12 each include one or more registration posts 26. These posts assist in aligning the core within a closed mold cavity during an injection molding process. The registration post 26 on the fin core hold the fin core in place when the core is set inside an over mold cavity, and during a casting or injection molding process. The posts ensure that the fin core is centered within the mold cavity. The post may be integral to the fin or on the sidewall of the walls of a mold cavity.

Figure 3:
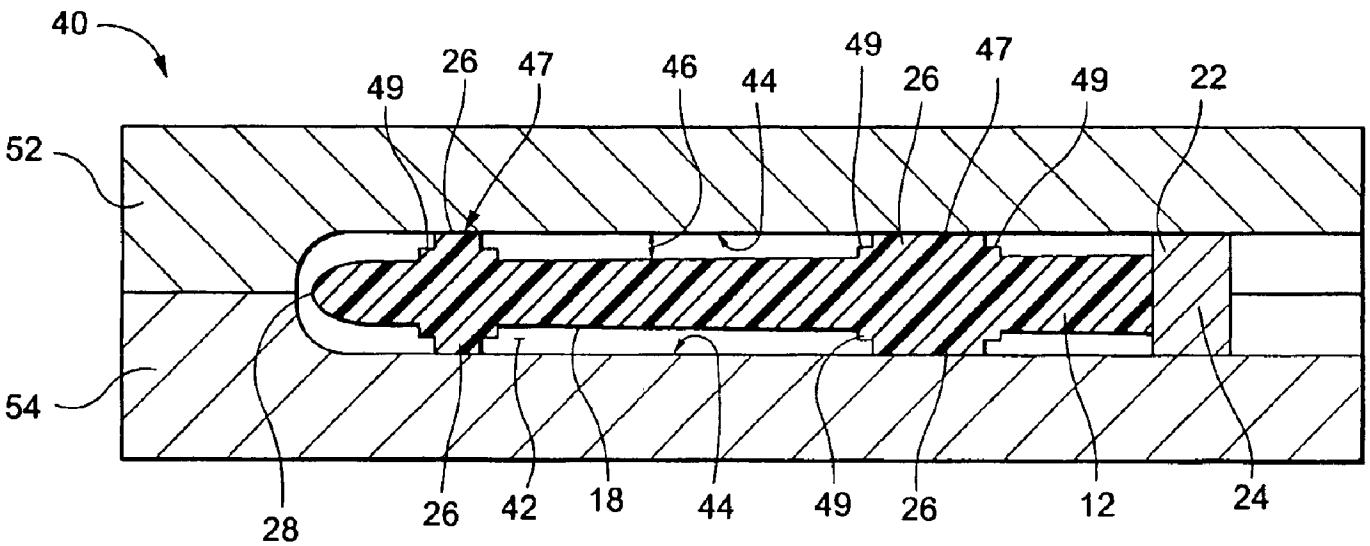
FIG. 3 is a cross-sectional side view of a fin core sitting inside an over mold cavity, with registration posts from the fin core abutting sidewalls the mold cavity.

FIG. 3 is a cross-sectional view of an over mold 40 with a fin rigid core 12 in the cavity 42 of the mold. The inner surface(s) 44 of the mold cavity conform to the outer surface of the completed surfboard fin. The base 22 of the fin is clamped in place by the over mold. When the fin core is placed in the over mold, the raised registration posts 26 press against a slightly recessed matching area 47 on the inside surface 44 of the over mold cavity. This abuts the posts against the cavity walls "locks" the core in place and prevents any shifting or flexing of the core as the cavity is filled with the soft material.

A gap 46 between the inner surfaces 44 of the cavity and the fin rigid core 12 are filled by an injection molded plastic that forms the soft cover layer 14 of the fin. The cover layer may be formed of rubber, silicones, urethanes or other such injection moldable material, and have a Shore A hardness of about 50 to 94 after being cured in the mold. The injection moldable material flows into the cavity through mold gates (not shown) that lead to the cavity, through the body of the mold and from an external source of the material. Mold gates and the injection of material into a mold cavity may be performed by conventional methods.

Figure 4:
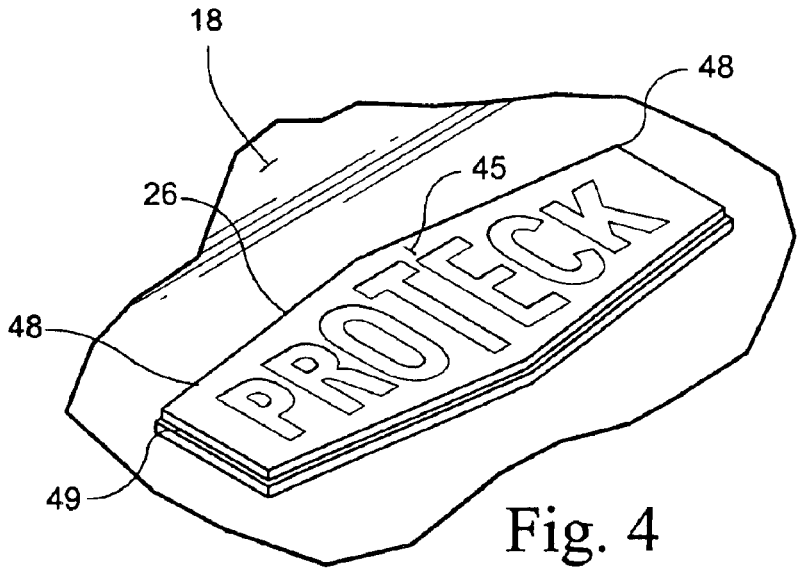
FIG. 4 is an enlarged perspective view of a registration post on a side of a rigid fin core.

FIG. 4 is an enlarged view of a registration post of a fin core. The registration post 26 is the same height as the thickness of the over molded injected material layer 14 that covers the fin core. The end outer surface 45 of each posts fits flush against an recessed (or protruding) wall section 47 of the over mold cavity when the core is mounted in the mold cavity. The mold wall may or may not have a raised or recessed surface opposite to the posts. The end surface braces the fin core against the wall of the mold. The shape and size of the end outer surface 45 of the registration posts 26 can vary to create a variety of design changes to the appearance of the fins. The outer post surfaces may be exposed after the cover layer is injected over the core. The outer end surfaces 45 of the posts may be molded or imprinted with a variety of logos, lettering, or graphic designs to enhance the appearance of the finished over molded fin. The logo, text and graphic design may be embedded in the outer surface of the post The outer surface 45 of the posts may have a ridge 48 at the outer perimeter of the surface. The ridge engages the inner surface 44 of the mold cavity 42 to provide a seal that prevents the injected plastic, during the molding process, from covering the logo, lettering and graphic design on the surface 48 of the post. The outer surface of the posts are exposed in the final fin and are not covered by the soft material layer 14. The logos, lettering and graphic design on the post are clearly visible on the finished surfboard fin.

Figure 5:
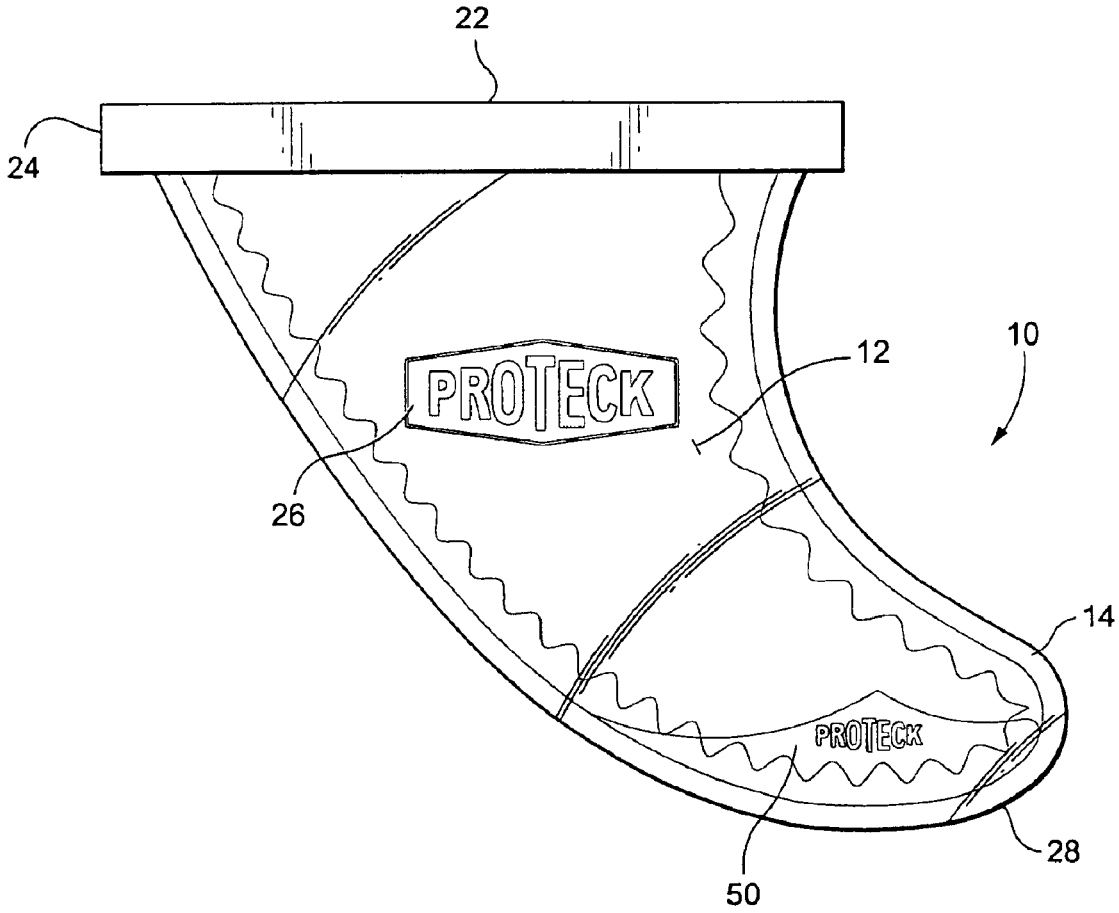
FIG. 5 is side view of another surfboard fin having a large registration post at a fin tip.

FIG. 5 shows a fin having an oversize registration post 50 on opposite sides of the core near the fin tip 28. The oversized registration post 50 may cover the entirety of the lower tip region of the fin core. The post 50 may be oversized to improve the centering alignment of core in the over mold cavity or to provide a large post surface for logos, lettering and graphics. The number of posts, their size and positioning on the sides of a fin are a matter of design choice. Two pair of registration posts 26, 50 may be positioned on the side of the fin core near the tip 28 and base 22. The posts may be positioned on opposite sides of the fin core of the fin and on both sides of the fin core. More than two pair of posts on opposite sides of the fin core may be required for larger fins.

The registration posts 26, 50 may have sidewalls that extend straight from the fin core to the outer surface 45, or may include sidewalls that have curvature between the fin core and outer surface. In addition, there may be small inlets or "steps" 49 around the top edges of the posts that allow the soft material to "hook" over the posts. The step prevents the soft material 14 from peeling or separating from the posts after the fin is completed.

Figure 6:
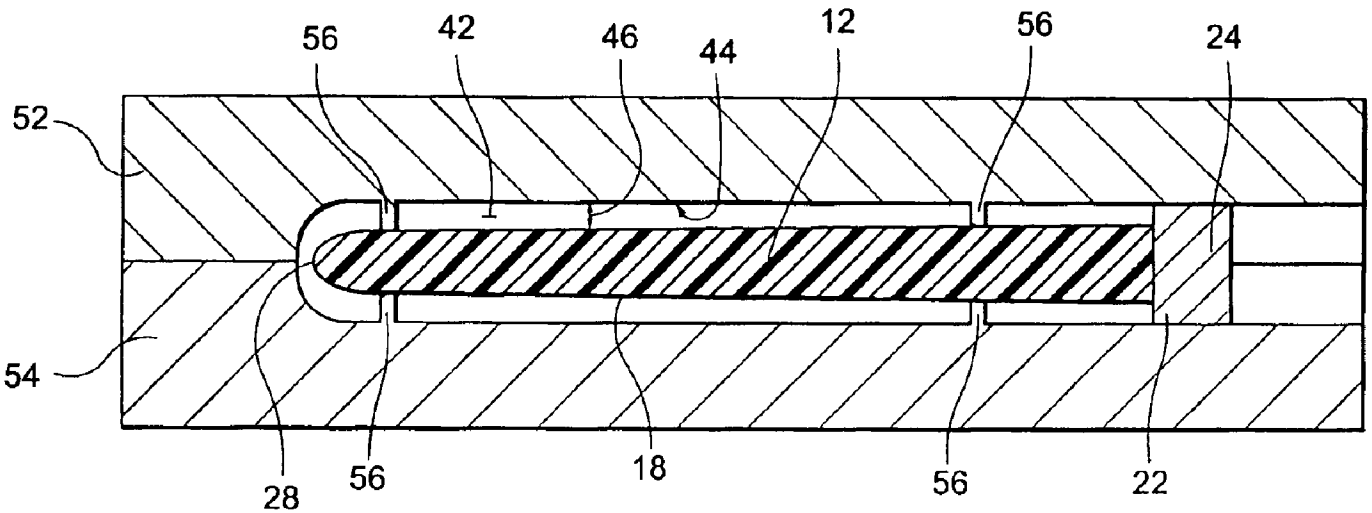
FIG. 6 is a cross-sectional side view of a fin core inside an over mold cavity, with registration posts from the sidewalls of the mold cavity abutting the fin core.

FIG. 6 is a cross-sectional view of a mold with a fin core clamped in place. To cover a core with a soft cover 14, the core 12 is mounted in the cavity 42 of an over mold. The fin core is centered in the cavity. The base 22 of the core is clamped by the mold half sections 52,54. The registration posts 56 are on the inside surface of the over mold cavity help center the core in the cavity. The posts 56 are designed to "capture" the core, and to hold it in place as the mold is filled with material. The sidewalls of the registration posts 56 are straight to facilitate removal of the posts from the cover layer 14, after the layer as cured and the mold halves are separated. If the mold registration posts 56 are aligned on the sides of the cavity wall, the locations of the posts are at the tip and base on both sides of the cavity. There can be more than two posts per cavity on larger cores. The heights of the posts 56 are the same as the thickness of the material (see gap 46) that over molds the sides of the core. The size and shape of the post can vary and be used to change the appearance of the fin.

After the fin has been over molded and removed from the cavity, there will be open areas in the over mold material corresponding to the removed registration posts 56. These holes are then filled with a similar material or a pre-molded plug that is pressed into the holes. The filled holes can function as décor or designs on the sides of the over molded fin. The plugs can be a rigid material or a soft material. The plugs may be glued by adhesives to the soft layer 14.

Figure 7:
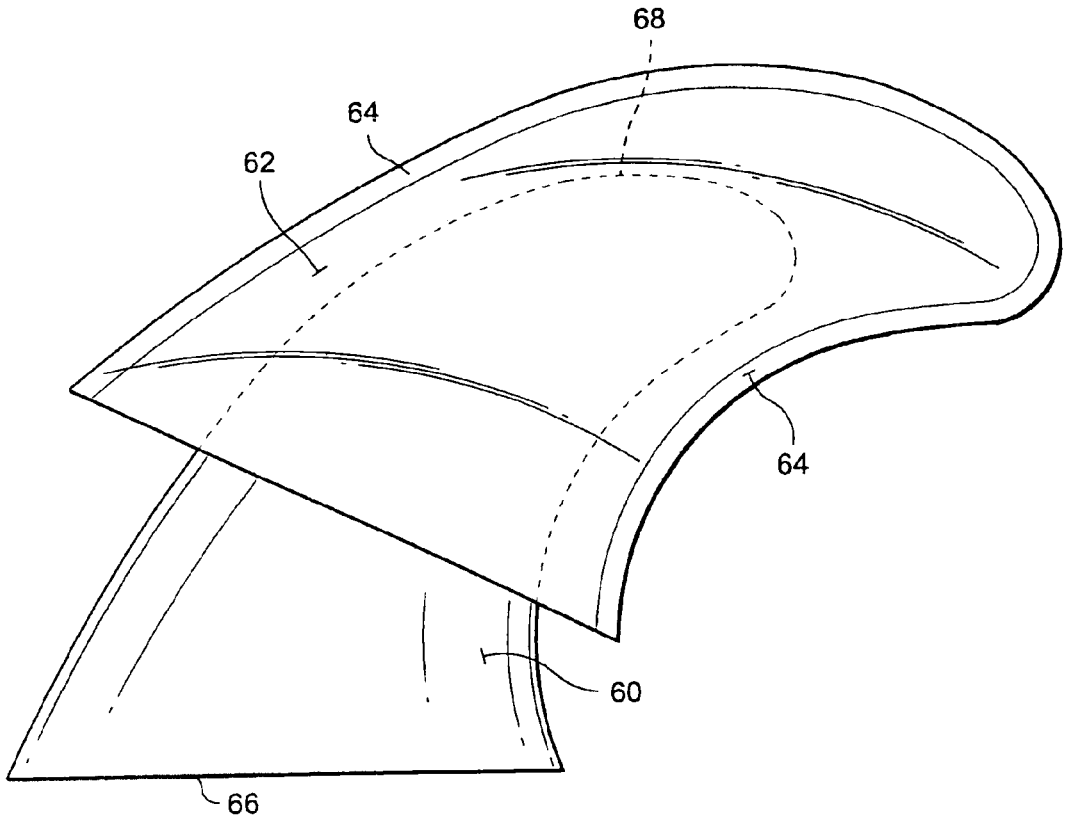
FIG. 7 is a side view of a soft fin sleeve covering being slid over a rigid fin core.

FIG. 7 is a schematic side view of a soft flexible "sleeve" 62 slides over a conventional rigid surfboard fin 60. This sleeve 62 does not rely on injection molding to fit the sleeve over the fin. This sleeve 62 is retrofitted on rigid fins 60 and to make them "safety fins." A conventional rigid fin covered with a "safety fin sleeve" would then have the benefits of a safety fin.

Figure 8:
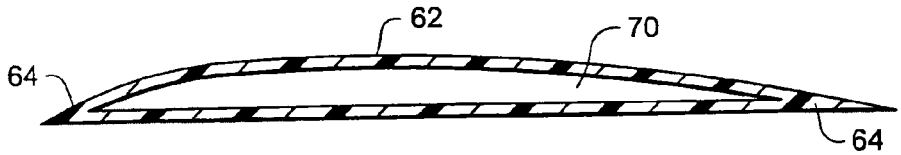
FIGS. 8 and 9 are cross section views of fin sleeves for a side fin and a center fin, respectively.
Figure 9:
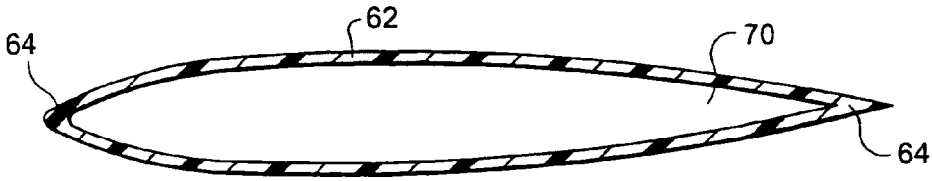

FIGS. 8 and 9 are cross-sectional views of sleeves 62 for side and center fins, respectively. The sleeves 62 are molded (independently of the fins) with a soft flexible material, such as urethane. The exterior shape of the sleeve will be the same shape as conventional fins. The sleeve 62 has flexible borders 64 at the leading and trailing edges of the fin. The sleeve fits over the tip 68 of the fin, slides over the fin and may cover the fin up to the fin base 66. The sleeve 62 will be molded with a hollow cavity 70 that allows a rigid fin to slide into. The sleeves may be designed to fit a variety of fin sizes and shapes. When the sleeve fits over a rigid fin, there will a soft leading and trailing edge around the leading and trailing edge of the rigid fin just like the safety fin.

The sleeves can be permanently glued to the rigid fin with a flexible structural adhesive that is applied along the sides of the rigid fin, prior to sliding on the sleeve. If the sleeve is not glued to the fin, it could be removed and replaced with a different size and shaped sleeve, to change the performance of the surfboard. A damaged sleeve could also be removed and replaced whether it is glued on or not. The safety fin sleeves are designed to make a hard, sharp, and rigid fin into a safety fin through retrofitting.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fin for an recreational device comprising:

a rigid fin core having opposite sides, leading and trailing edges and a base;

at least one registration post on each of said opposite sides of the core, and a flexible material substanially covering the opposite sides of said core, wherein said flexible material further comprises leading and trailing fin borders extending outward from said leading and trailing edges of the core, wherein said flexible material encircles the at least one registration post and an end surface of the at least one registration post is adjacent an outer surface of the flexible material.

2. A fin as recited in claim 1 wherein said flexible material is selected from a group consisting essentially of rubber, silicones, and urethanes.

3. A fin as recited in claim 1 wherein the leading and trailing borders are in a plane of the core.

4. A fin as recited in claim 1 wherein the registration post outer surface includes visible indicia.

5. A fin as recited in claim 1 wherein said registration post outer surface includes a logo.

6. A fin as in claim 1 wherein said fin is for at least one of a surfboard, wind surfboard, water ski, wake board and jet ski.

7. A fin as recited in claim 1 wherein said at least one registration post includes a step ledge in a sidewall of the post.

8. A fin as recited in claim 1 wherein the at least one registration post includes a upstanding ridge around a perimeter of the post.

9. A fin as recited in claim 1 wherein the at least one registration post comprises a first pair of posts on opposite sides of the fin core and on an upper half of the fin core, and a second pair of posts on opposite sides of the fin core and arranged proximate to a tip of the fin core.

10. A fin as recited in claim 9 wherein said second pair of posts each have a surface area on a distal end of the post which is substantially greater than a surface area of a distal end of each of said first pair of posts.

11. An over mold system for a fin for a recreational device comprising:

an over mold cavity having an inner surface shaped to match an outer surface of said fin, wherein the mold cavity has a first width;

a rigid fin core having opposite sides, at least one edge and a base, wherein said core has a second width substantially narrower than said first width of the cavity;

at least one registration post on each of said opposite sides of the core, wherein said post abuts the inner surface of the mold and abuts one of the opposite sides of the core when the fin core is in the mold, and a flexible material injected into said cavity and substantially covering the opposite sides of said core, wherein said flexible material further comprises a leading and trailing fin edges extending outward from said at least one edge of the core, and wherein the at least one registration post extends through the flexible material and said flexible material has an outer surface adjacent an outer end surface of each of the at least one post.

12. An over mold system as in claim 11 wherein said at least one post is integral with the core.

13. An over mold system as in claim 12 wherein a pair of said at least one post are aligned with each other and are on opposite sides of the core.

14. An over mold system as in claim 11 wherein said post is integral with the inner surface of the mold cavity.

15. A over mold system as recited in claim 11 wherein said flexible material has a Shore A hardness of about 50 to 94.

16. An over mold system as recited in claim 11 wherein said outer end surface of the post includes a logo, text or graphics, embedded in said surface.

17. A over mold system as recited in claim 11 wherein said core has a rounded tip at an intersection between said leading and trailing edges, and both said leading and trailing edges are curved, said leading edge curved toward said trailing edge.

18. A sleeve for a rigid fin of a recreational device comprising:

a sleeve envelope have a cavity to receive the rigid fin, wherein said cavity conforms to opposite outer side surfaces of said fin, and said sleeve envelope substantially covers the outer side surfaces of the fin when the fin is in the envelope;

a soft, flexible border to said envelope forming a leading and trailing edge of said envelope, wherein said boarder is substantially parallel to said rigid fin and said border defines a perimeter of the cavity, and an open edge of the cavity adapted to slide over the rigid fin and to abut to a base area of said fin.

19. A sleeve as in claim 18 further comprising a first sleeve side and a second sleeve side, wherein said first sleeve side is substantially planar and said second sleeve having a curvature matching a curved side of a side rigid fin, wherein said cavity conforms to an outer surface of said side rigid fin.

20. A sleeve as in claim 18 further comprising a first sleeve side and a second sleeve side, wherein said first sleeve side and said second sleeve each have a curvature matching a curved side of a side rigid fin, wherein said cavity conforms to an outer surface of said side rigid fin.

* * * * *